United States Patent [19]

Min

[11] 4,219,929

[45] Sep. 2, 1980

[54] FINGER-TOE NAIL CLIPPER HAVING SHIFTING RECEPTACLE

[76] Inventor: Manki Min, 21-08, 28th Ave., Astoria, Long Island City, N.Y. 11102

[21] Appl. No.: 7,318

[22] Filed: Jan. 29, 1979

Related U.S. Application Data

[63] Continuation of Ser. No. 858,022, Dec. 6, 1977, Pat. No. 4,150,481, which is a continuation-in-part of Ser. No. 680,377, Apr. 26, 1976, Pat. No. 4,062,109.

[51] Int. Cl.[3] ..... A45D 29/02
[52] U.S. Cl. ..... 30/28
[58] Field of Search ..... 30/28, 29; 132/73

[56] References Cited

U.S. PATENT DOCUMENTS

| | | | |
|---|---|---|---|
| 2,887,773 | 5/1959 | Killen | 30/28 |
| 2,970,376 | 2/1961 | Kuo | 30/28 |
| 3,031,754 | 5/1962 | Pocoski | 30/28 |
| 3,188,737 | 6/1965 | Chase | 30/28 X |
| 3,838,507 | 10/1974 | Clark | 30/29 |
| 3,943,948 | 3/1976 | Sartore | 30/28 X |
| 4,062,109 | 12/1977 | Min | 30/28 |
| 4,150,481 | 4/1979 | Min | 30/28 |

*Primary Examiner*—Jimmy C. Peters

[57] ABSTRACT

An improved finger-toe nail clipper including the combination of a conventional finger or toe nail clipper and a compactly designed receptacle shiftingly receivable between the opposing insides of the forward nail clipping ends of the arms of the clipper and opening forwardly toward the opposing nail cutting edges of the clipper arms for catching and retaining the clipped-off finger or toe nail portions as desired.

10 Claims, 12 Drawing Figures

FINGER-TOE NAIL CLIPPER HAVING SHIFTING RECEPTACLE

This application is a continuation of Ser. No. 858,022 filed Dec. 6, 1977, now U.S. Pat. No. 4,150,481, issued Apr. 24, 1979, which in turn is a continuation-in-part of Ser. No. 680,377, filed Apr. 26, 1976, now U.S. Pat. No. 4,062,109.

BACKGROUND OF THE INVENTION

The modified conventional finger or toe nail clipper is provided with a pair of generally parallel hardened resilient steel upper and lower strip members having front and rear ends, and the front ends include laterally curved or straight inturned mating cutting edges in spaced-apart, face-to-face relationship while the rear ends of the strip members are secured together to permit the front ends and said mating cutting edges to be moved toward and away from each other.

Between the front ends of said strip members is defined a space to mount a shiftingable receptacle for catching, holding and discharging the clipped-off finger or toe nail portions.

A round support post is disposed through the aligned apertures formed through in the forward portions of the strip members near the cutting edges of the strip members and the post is provided with a round head at lower end and means for hinging an operating lever near the upper end, the operating lever being provided to apply a force to effect movement of the front ends, and thus the inturned mating offset cutting edges together.

The present invention is an another improved finger or toe nail clipper designed more distinctively than my patent pending parent invention of Ser. No. 858,022, filed Dec. 6, 1977, FINGER-TOE NAIL CLIPPER HAVING SHIFTING RECEPTACLE.

Numerous clippers for the same purpose have been previously patented and some have included a structure for catching and releasably retaining clipped-off nail portions. However, few of these latter forms have been widely utilized because of inability to perform as desired, high cost of manufacture, adverse appearance, etc.

BRIEF DESCRIPTION OF THE INVENTION

The present invention relates to an improved finger-toe nail clipper and more particularly to a combination of various types of modified conventional finger or toe nail clippers and the provision of a receptacle to catch and hold the cut-off finger or toe nail portions and removable for emptying the receptacle.

This invention is also well designed for more satisfaction in the points of above-mentioned reasonable needs of utilizability.

In order to eliminate troublesome problems deriving from the using of previous conventional finger or toe nail clippers, the present invention is also designed for simple and more distinctive construction to be efficient and durable, and comprises a practical device for catching, holding and sanitary discharging the severed finger or toe nail portions wherever it is used.

This invention is also provided with an adapting receptacle or a housing member to be accommodated in the space between the front end portions of the hardened resilient steel strips for catching and holding the portions of the clipped-off finger or toe nail.

The principal object of the invention is to provide an improved finger-toe nail clipper including a structure for catching and holding severed finger or toe nail portions until the storage of clipped-nail portions may be emptied in a desired receptacle, such as trash bags, garbage cans, or the like.

A further object of the invention is also to provide a convenient handling means for the receptacle in the present invention in process of assemblying and disassemblying.

A further object of the invention is to provide means for sanitary discharging the accumulated severed nail portions by merely shifting the receptacle from its catching and holding position to its discharging position.

A further object is to provide a way of enjoying the cutting manner of the conventional finger or toe nail clippers by just keeping the receptacle staying in the discharging engagement position.

Another object of this invention is to provide a simple room consisted of wall means to catch and hold the severed nail pieces.

Another object of this invention is to provide guide members thereof by merely enlarging respectively downwardly and upwardly a pair of opposing longitudinal side walls of the receptacle to be overlapped the opposite longitudinal sides of said upper and lower strip members to be prevented it from seperating in the mounted attitude, while permitting slidable movement back and forth with the outside surfaces of said longitudinal side walls provided with knurled surfaces for non-slip operation.

Still another object is to provide a receptacle adaptable to the varying intermediate space between a pair of said strip members when said cutting edges are in cutting motions.

The various functions of aforesaid objects of this invention have been designed into only a simple embodiment, a plain and distinctive receptacle; this is the most important features in this invention.

These together with other objects and advantages which will become subsequently apparent reside in the detail of construction and operation as more fully hereinafter described and claimed, reference being had to the accompanying drawings forming a part hereof, wherein like numerals refer to like parts throughout.

DETAILED DESCRIPTION OF THE INVENTION

Figure 2:
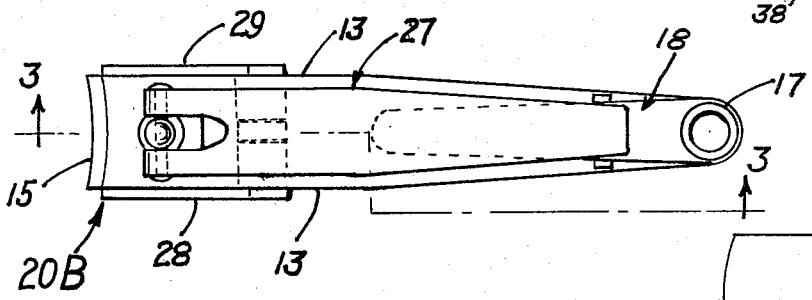
FIG. 2 is a top view of the first embodiment showing section line 3—3 (newly added)

Referring to the drawings, the improved finger-toe nail clipper having shifting receptacle characterizing the present invention comprises a pair of hardened resilient elongated steel strip upper and lower members or arms 11 and 12 having respectively forward and rearward end portions, which are respectively connected with each other by remarkably inclined strip portions 11' and 12', and opposite longitudinal sides 13, 13 and 14, 14 in upper and lower forward end portions thereof, said forward end portions being slightly divergent and spaced-apart, face-to-face for movements toward and away from each other, the forward terminal ends of upper and lower strip members 11 and 12 have downturned and upturned mating cutting edges 15 and 16, respectively, opposing each other and extending transversely, thus forming in curved or straight cutting edges for neat trimming and shaping cut of nail portions to be cut therebetween as best seen in FIG. 2, while said rearward end portions being rigidly joined together by suitable means, such as spot-welding, hinging, brazing or riveting, etc., to allow said divergent forward end portions of said strip members 11 and 12 a springy movement toward and away from each other while preparing thereon an eyelet joint 17 with a desired attachment 18, whereby a desirably defined space 19 being obtained between said divergent portions of the strip members 11 and 12 to receive receptacles 20B, 20C, 20D therebetween being shiftingable longitudinally for selective engagements of said receptacles for retaining and discharging cut-off nail portions 21.

An upstanding post 22 having a round head 23 at it's lower end is disposed in slip-fit and being in journal therein vertically aligned two bores 25, 26 with said round head 23 thereof bearing against the opposing outside surface portion of said lower strip member 12, said bores 25, 26 are opened respectively through said forward end portions of the strip members 11, 12 right behind said cutting edges 15, 16 and respectively intermediate said opposite longitudinal sides 13, 13 and 14, 14 thereof.

An operating lever 27 having a downwardly projected portion 27', which is provided adjacent the pivoted or hinged end portion of said operating lever 27 to define a fulcrum point with the forward end portion of the upper strip member 11 for its operating engagement, the operating lever 27 is supported by a interconnecting means of hinging or pivoting from the upper end of said post 22 and being swingable into and out of position operative to force and release said divergent forward end portions of the strip members 11 and 12 toward and away from each other, thus actuating said cutting edges 15 and 16 into cutting engagement with each other.

The receptacles 20B, 20C, 20D are longitudinally shiftingly mounted or received in said defined space 19 therebetween for selective engagements of said receptacles to receive and discharge clipped-off nail portions 21, said receptacles 20B, 20C, 20D are respectively comprised of wall means basically combined with opposite longitudinal side walls 28, 29 and corresponding one of rear wall structures 30', 30'', 30'''.

Said rear wall structures 30', 30'', 30''', are all laterally upwardly disposed between rearward portion of said opposite longitudinal side walls 28, 29 to close the rearward open side of said all receptacles to form a housing room with the opposite longitudinal side walls 28, 29 in the defined space immediately rearward of said cutting edges 15, 16 to receive the cut-off nail portions 21.

Figure 5:
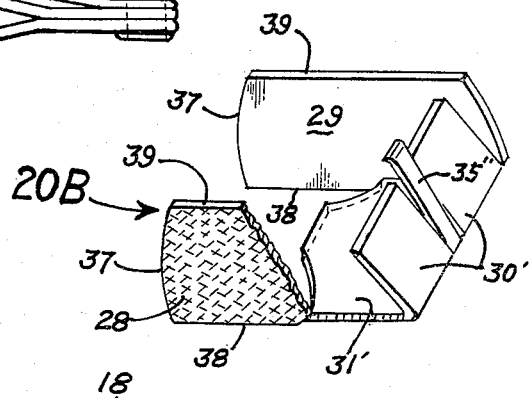
FIG. 5 is a perspective view of the first enlarged receptacle partially in section (same as FIG. 11, in original drawing)

In receptacles 20B, 20C (FIGS. 5,7), a lower abutting wall member 31' having a forwardly extended wall portion therefrom is flatly disposed therebetween, and secured relative to the rearward lower marginal edges of said opposite longitudinal side walls 28, 29, a rear wall structure 30' in receptacle 20B, which is forwardly upstanded and includes intermediately therein an upwardly inclined leaf spring member 35'' having an upper free end and the other lower end, which is secured, together with the lower marginal portion of said upwardly inclined rear wall 30', to the rearward marginal edge of said lower abutting member 31', thereby forming in a room having a rearward closed wall structure comprised of said rear wall 30' with leaf spring member 35'' and said opposite longitudinal side walls 28, 29 in said defined space 19 therebetween, meanwhile allowing a springy movement to said spring member 35'' when in the cutting movements of said cutting edges 15, 16 with each other to be adapted to maintain the receiving engagement of said receptacle in the varying space of said defined space 19 upon said cutting engagements thereof, and to the rear wall 30' to cover the undesirable jamming action occasionally happendable therebetween said inclined strip portions 11' and 12' thereof to avoid undesirable deforming or breakage, causing therefrom, of the invention, said upper free end thereof is normally being in the state of depressive abutting against the opposite under surface portion of said upper strip member 11, thus resulting in keeping said lower abutting member 31' abutted against opposite upper surface portion of said lower strip member 12.

Figure 6:
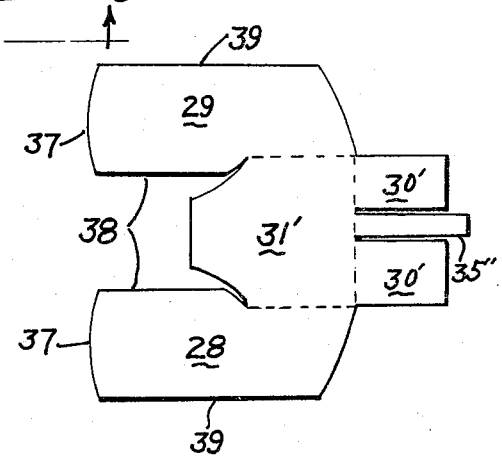
FIG. 6 is a development figure of the first receptacle showing dot-lines for bending positions to form the first enlarged receptacle of FIG. 5 (same as FIG. 12, in original drawing)

Said receptacle 20B may be easily obtained by bending operations along the dot-lines indicated in the development fingure of FIG. 6.

Figure 7:
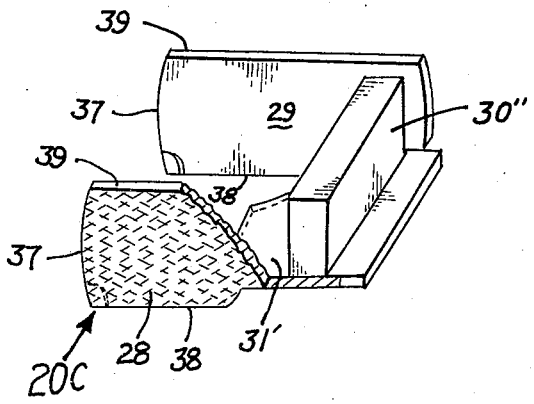
FIG. 7 is a perspective view of the second enlarged modified receptacle partially in section (same as original FIG. 14)
Figure 8:
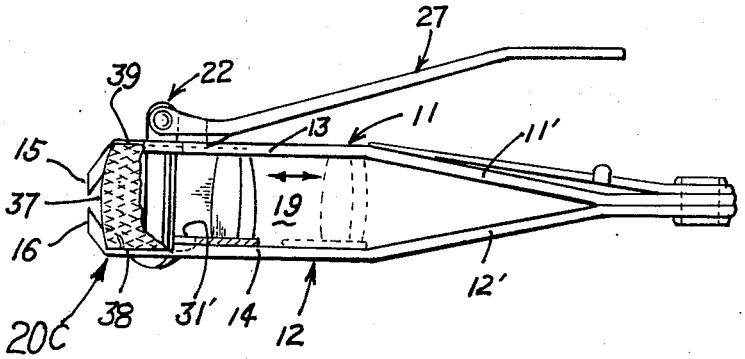
FIG. 8 is a front view of the nail clipper including the second modified receptacle partially opened, and showing its discharging attitude in dot-lines (same as original FIG. 15)

The rear wall structure 30'' in receptacle 20C is made of tough resilient rubber material or the like and shaped preferably in hexahedron or a blocklike, which is mounted and secured at its bottom surface to the rear portion of said lower abutting member 31' to be upwardly laterally disposed therebetween and closed the rear open side of the receptacle 20C as best seen in FIG. 7, the upper free end surface of the rear wall structure 30'' is depressively abutted against the under surface portion of the upper strip member 11, thus resulting in maintaining the lower abutting member 31' being abutted against the opposite upper surface portion of said forward end portion of the lower strip member 12 as best seen in FIG. 8.

Figure 9:
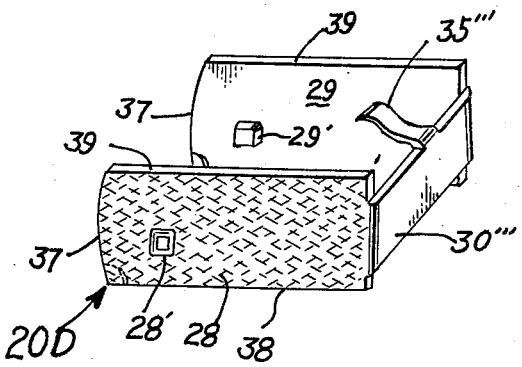
FIG. 9 is a perspective view of the third enlarged modified receptacle (same as original FIG. 16)
Figure 11:
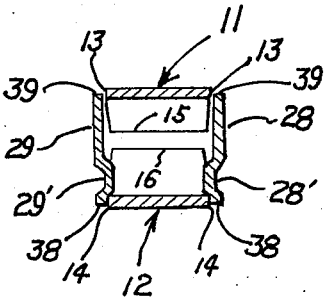
FIG. 11 is a sectional view taken generally along the line 11—11 in FIG. 10 (same as original FIG. 18)
Figure 10:
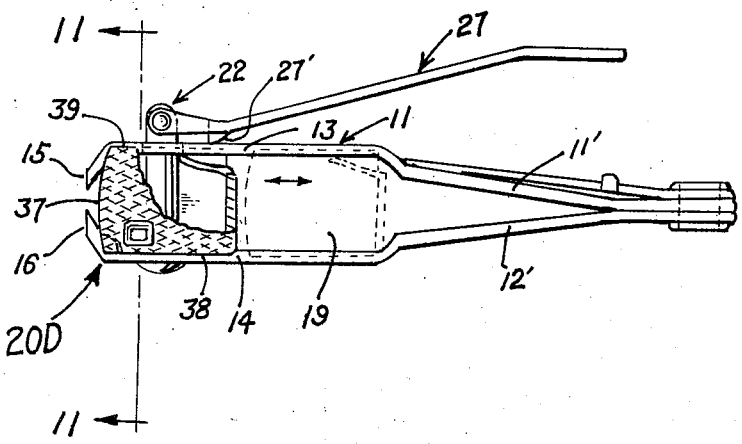
FIG. 10 is a front view of the nail clipper including the third modified receptacle partially opened and showing section line 11—11, and the discharging position of said receptacle in dot-lines (same as original FIG. 17)

In the receptacle 20D in FIG. 9, the rear wall structure 30''' is upwardly, laterally disposed between and anchored relative to the rear marginal edges of opposite longitudinal side walls 28, 29, a forwardly and slight upwardly stretched abutting leaf spring member 35''' having a free end and the other end secured to the central upper marginal edge portion of said rear wall 30''', an opposite inwardly projected wall portions 28', 29' are respectively provided in forward-downward portions of said longitudinal side walls 28, 29, which are respectively mounted on opposite upper marginal surface portions of the lower strip member 12, and guided thereon along to make the receptacle 20D shift longitudinally as appreciable from FIGS. 11, 10.

The free end of said abutting leaf spring member 35''' thereof is normally depressively abutted against the under surface portion of said forward end portion of the upper strip member 11, thus resulting in keeping the lower marginal edge of the rear wall 30''' and said opposite inwardly projeted wall portions 29', 28' beared on the opposing upper surface portions of the forward end portion of the lower strip member 12 as seen in FIGS. 10, 11 to maintain a closing room to receive the clip-off nail portions 21 in the varying defined space 19 therebetween when the cutting edges 15, 16 are in cutting engagement with each other.

Figure 1:
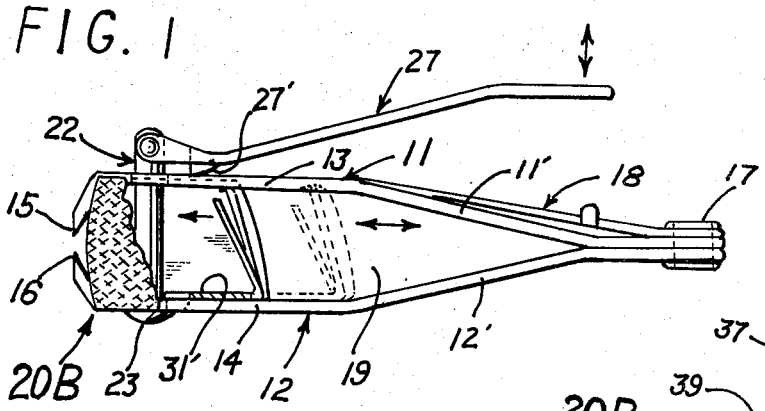
FIG. 1 is a front view of the first embodiment of the invention including a partially opened receptacle showing its discharging attitude in dot-lines (same as original FIG. 13)
Figure 3:
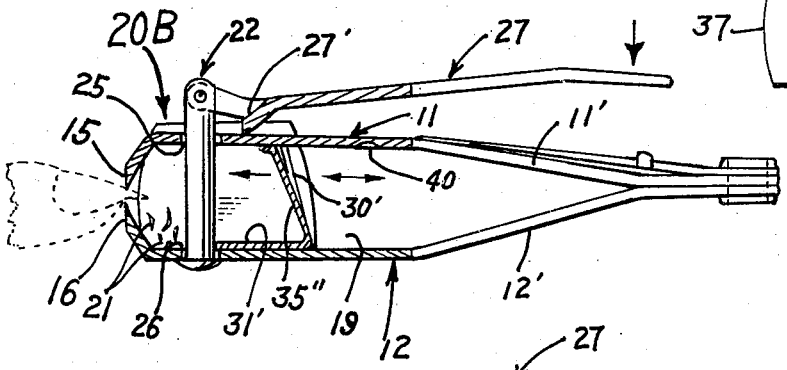
FIG. 3 is a front view of the first embodiment partially in section taken along the line 3—3 in FIG. 2, viewed in the direction indicated by the arrows, and showing accumulated severed nail portions and finger nail introduced between respective inturned mating cutting edges (newly added)

The height dimension of the rear wall structure 30' and 30''' in receptacles 20B and 20D are adapted to be slightly less than that of a minimum defined space 19 therebetween when the cutting edges 15, 16 are in its cutting engagement with each other to assure a free cutting motions of the cutting edges 15, 16, accordingly providing a small gap between said upper marginal edges of the rear wall structure 30' and 30''' and the under surface of said upper strip member 11 in normal unengagement of said cutting edges 15, 16 with the receptacles 20B, 20D in receiving position respectively, as would be known from FIGS. 1, 3 and 10.

Wherein the opposite longitudinal walls 28, 29 have respectively knurled outside surfaces (as marked in inclined dot-lines crossed each other) for non-slip operation, an opposite forward curved marginal edges 37, 37 thereof to define closure walls for the opposing longitudinal side openings right behind the cutting edges 15, 16, and downwardly and upwardly extended opposite wall portions 38, 38 and 39, 39 being provided respectively for longitudinal guide and closure wall means of the receptacles 20B, 20C, 20D.

Said opposite downwardly and upwardly extended wall portions 38, 38 and 39, 39 are respectively slidingly overlaid the opposite longitudinal sides 14, 14 and 13, 13 thereof and guided thereon along the longitudinal sides 14, 14 and 13, 13 thereof to shift the receptacles longitudinally, thus producing a convenient way of selective engagements thereof relative thereto between receiving and discharging engagements, forward and rearward positions respectively.

In operation of first embodiment of the invention in FIG. 1, a forwardly advancing component force as arrow-marked is produced from the abutting engagement of said free end of the upwardly inclined leaf spring member 35'' against the under surface portion of slightly divergent (slightly inclined from forward to rearward) forward end portion of upper strip member 11, upon cutting motions of the cutting edges 15, 16, said advancing component force keeps the front marginal edge portion of said forwardly extend portion of the lower abutting member 31' abutted against the rear lower opposing surface portion of the post 22, thus resulting in enabling the receptacle 20B to be held in forward position for receiving engagement therefor, and with the free end of said inclined leaf spring member 35'' seated in the recess 40, which is downwardly opened in the rearward under surface portion of the forward end portion of the upper strip member 11, the discharging engagement and non-active positioning of the receptacle 20B is to be done.

Figure 12:
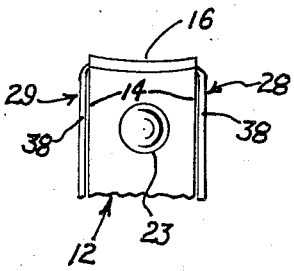
FIG. 12 is a bottom plan segment view showing the attitude of relatively frictional fitting of the inwardly projected guide wall portions with the opposite longitudinal sides of the lower strip member in the second and third embodiments of the invention to provide a selective self-positioning means for the second and third receptacles respectively (same as original FIG. 19).

In the second and third embodiments of the invention in FIGS. 8, 10, the opposing forward-downward corner portions of the longitudinal side walls 28, 29 of the receptacles 20C, 20D have respectively inwardly projected wall portions being relatively frictionally fitted with the opposite longitudinal sides 14, 14 thereof as seen in FIG. 12 for providing a selective self-positioning means therefor, consequently the requirements of forward position or receiving engagement of the receptacles 20C, 20D are to be respectively met with the disposing actions: with the forward marginal edge of the forwardly extended portion of said lower abutting member 31' in receptacle 20C and the free end portion of said abutting leaf spring member 35''' in receptacle 20D respectively by disposing to be abutted against the rear opposing surface portion of the post 22 as seen in FIGS. 8, 10, and meanwhile for rearward or discharging or non-active position, with just disposing the receptacles 20C, 20D in rearward position overcoming the frictional resistance from said fitted portions as easily appreciable when referring to the dot-lined position thereof in FIGS. 8, 10.

The opposite inclined portions 11' and 12' in upper and lower strip member 11 and 12 in third embodiment of the invention include stepped portions to have a reduced portion with such a rapid manner in height dimension of the defined space 19 therebetween to avoid the undesirable jamming action occasionally happenable rearmost therebetween, by offering a provision of a definite action of limiting the longitudinal displacement to rearward direction for the receptacles 20D as could be appreciable from FIG. 10.

Figure 4:
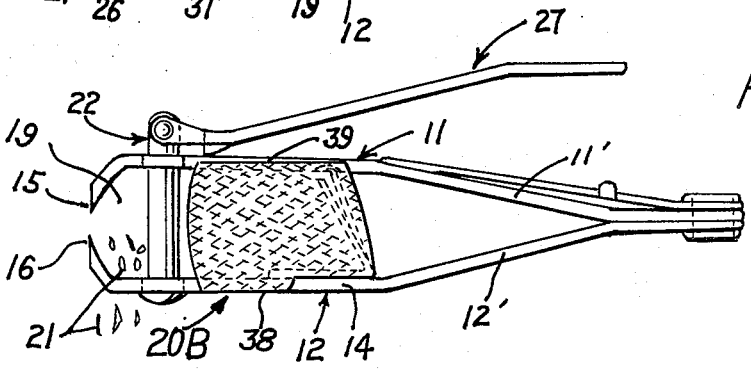
FIG. 4 is a front view of the first embodiment with the first receptacle staying in the discharging engagement position, and the attitude of discharging the deposited severed nail portions (newly added)

In summary, the common distinctive features in its operation of the present invention are drawn to as followings: with said receptacles 20B, 20C, 20D being disposed in forward or receiving position in accordance with the functionings of aforementioned corresponding positioning and spring means, one could actuate said operating lever 27 up-down like the same manner as in conventional clippers, thus resulting in said cutting edges 15, 16 to clip off the nail portions being introduced therebetween, and consequently the clipped-off nail clipping 21 is to be accumulated without flying about in said receptacles 20B, 20C, 20D to a desired amount until the simple manual action of shifting back the receptacles 20B, 20C, 20D to its rearward or discharging position and let it hold on itself in the same position by the functioning of aforementioned corresponding positioning means, thereby the accumulated nail-clippings will be easy and extremely sanitarily disposable at one's option, and furthermore one could enjoy the advantage of the conventional cutting manner with keeping said receptacles in the above same discharging position, for better understand, please, refer to FIGS. 1, 3, 4.

The foregoing is considered as illustrative only of the principles of the invention.

Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed is follows:

1. A finger-toe nail clipper having shifting receptacle, comprising a pair of horizontally disposed upper and lower elongated spring material strip members including forward and rearward end portions, which are respectively connected with each other by remarkably inclined opposing portions, and opposite longitudinal sides in each forward end portion thereof, said rearward end portions being rigidly joined together by suitable means and said forward end portions being slightly divergent and spaced apart for movement toward and away from each other, the forward terminal ends of said upper and lower strip members including downturned and upturned mating cutting edges, respectively, opposing each other and extending transversely of said forward end portions, thus forming in curved edges for neat trimming cut of nail portions therebetween, whereby a desirably defined space obtained between said divergent forward end portions of the strip members to receive a receptacle being shifting longitudinally for selective engagements of said receptacle to receive and discharge the cut-off nail portions, an upstanding post having a round head at its lower end disposed in slip-fit and being in journal in the vertically aligned two bores with said round head thereof beared against the opposing outside surface portion of the lower strip member, said two bores being opened respectively through the forward end portions of said strip members, an operating lever pivotally supported from the upper end of said post and being engageable with said upper strip member and swingable into and out of position operative to force said forward end portions of said strip members toward each other, thus bring said cutting edges into cutting engagement with each other, a longitudinally shifting receptacle for receiving and discharging the cut-off nail portions, said receptacle being comprised of wall means including an opposite longitudinal side walls of said receptacle and rear wall means being supported between said opposite longitudinal side walls to close the rear open side of said receptacle, thus providing a closing room immediately rearward of said cutting edges between said forward end portions of said strip members to receive the cut-off nail portions, a guide means provided with the opposing projected portions from said opposite longitudinal side walls and disposed to be guided along said opposite longitudinal sides of the strip members for longitudinal shift of the receptacle to provide a convenient way of selective engagements of the receptacle to receive and discharge the clip-off nail portions, a spring means being associated with at least one of said wall means and being engageable with at least one of said strip members to serve to maintain said closing room being in attitude to receive the clip-off nail portions in the varying defined space therebetween right behind of said cutting edges in its cutting engagement with each other, a positioning means being in combined relations with at least one of said wall and spring means for selective positions of the receptacle relative thereto between forward and rearward, active and inactive positions, respectively.

2. A finger-toe nail clipper having shifting receptacle as defined in claim 1, wherein said rear wall means includes a rear wall structure being comprised of a forwardly upstanding and laterally disposed rear wall member to be contiguous, along at the opposite sides of said forwardly upstanding rear wall member, with the opposite inside surfaces of said opposite longitudinal side walls, and a leaf spring member being included therein intermediately in said rear wall member, the lower end of said leaf spring member and the lower marginal transverse edge of said rear wall member are together with secured to the rear marginal edge of a lower abutting member, which is flatly disposed between said opposite longitudinal side walls and being anchored relative to the rearward lower marginal edge portions thereof, therefore preparing a closure wall structure with said leaf spring member for the rearward open side of first receptacle, and allowing a springy movement to said rear wall member when in undesirable jamming action between said remarkably inclined strip portions thereof to avoid any deteriorating results to the invention, a small gap tolerance is provided between the upper marginal edge of said rear wall member and the under surface of said upper strip member for free cutting engagement of said mating cutting edges thereof with each other.

3. A finger-toe nail clipper having shifting receptacle as defined in claim 1, wherein said rear wall means also includes a rear wall structure comprised of a resilient durable material block-like member, which is upwardly and laterally disposed to be contiguous, at the opposite vertical sides of said block-like member, with the opposite inside surfaces of said longitudinal side walls, and secured at the bottom face of said block-like member to the rear upper surface portion of said lower abutting member, and abutted against the opposing under surface portion of said upper strip member at the upper surface of said block-like member, thus resulting in forming a closure wall of the rearward open side of the second receptacle, while allowing a springy movement itself responsive to the cutting motions of said mating cutting edges thereof.

4. A finger-toe nail clipper having shifting receptacle as defined in claim 1, wherein said rear wall means still includes a rear wall structure comprising a rear wall member being upwardly and laterally disposed between said opposite longitudinal side walls, and anchored relative to the rear marginal edges of said longitudinal side walls, thus providing a rear wall closure for the rearward open side of the third receptacle, a small gap tolerance being provided between the upper marginal edge of said rear wall member and the under surface of said upper strip member for free cutting motions of said mating cutting edges thereof, a abutting leaf spring member being included intermediately and extended from the upper marginal edge portion of said rear wall member.

5. A finger-toe nail clipper having shifting receptacle as defined in claim 1, wherein said spring means includes a leaf spring member having a free end and the other end, which member being included intermediately therein said forwardly upstanding rear wall member of said first receptacle, being secured to the rear marginal edge of said lower abutting member, said free end thereof being depressively abutted against the opposing under surface portion of said upper strip member, serving to hold lower abutting member being abutted against upper surface portion of said lower strip member, consequently resulting in maintaining said first receptacle being in engagement of receiving nail clippings in the varying defined space between said upper and lower strip members when said mating cutting edges thereof in cutting engagement.

6. A finger-toe nail clipper having shifting receptacle as defined in claim 1, wherein said spring means also includes a block-like spring member made of resilient durable materials, which is upwardly and laterally disposed therebetween, and respectively contiguous, at the opposite vertical faces thereof, with the opposite inside surfaces of said longitudinal side walls and secured, at the bottom face thereof, to the rear marginal upper surface portion of said lower abutting member and depressively abutted, at the upper transeverse face thereof, against the opposing portion of under surface of said upper strip member while allowing a springy engagement to itself in accordance with the cutting engagement of said mating cutting edges, serving to keep said lower abutting member being abutted against upper surface portion of said lower strip member, thus resulting in maintaining the second receptacle to receive the clipped-off nail portions.

7. A finger-toe nail clipper having shifting receptacle as defined in claim 1, wherein said spring means still includes a abutting leaf spring member having a free end and the other end being secured to the marginal upper central edge portion of said rear wall member in the third receptacle, and said free end thereof being depressively abutted against the opposing under surface portion of said upper strip member while permitting its spring engagement according to the cutting engagement of said mating cutting edges thereof, thereby keeping the lower marginal edge of said rear wall member as well the opposite inwardly projected wall portions of said longitudinal side walls being abutted against the opposing upper inside surface portions of said lower strip member, consequently, resulting in obtaining an receiving attitude of said third receptacle in the front position of said defined space therebetween.

8. A finger-toe nail clipper having shifting receptacle as defined in claim 1, wherein said guide means includes an opposite projected wall portions, respectively, from upper and lower marginal edges of said opposite longitudinal side walls thereof and being respectively slidably overlaid the opposite longitudinal sides of said upper and lower strip member and being guided along said longitudinal sides thereof for selective engagements of the receptacle relative thereto between forward receiving and reward discharging positions, respectively.

9. A finger-toe nail clipper having shifting receptacle as defined in claim 1, wherein said positioning means includes a forwardly upstanding leaf spring member being included intermediately therein in said forwardly upstanding rear wall member, and having an upper free end and the other lower end being secured to the rear marginal edge portion of said lower abutting member, said upper free end thereof is depressively abutted against the opposing inside surface portion, defining an abutting point therewith, of said upper strip member, which is slightly downwardly inclined from forward to rearward, thus a forwardly advancing component force being produced from said abutting point, said component force is serving to maintain the forward marginal edge portion of said lower abutting member being abutted against the lower rearward surface portion of said upstanding post when in the cutting engagement of said mating cutting edges thereof, to provide a forward positioning engagement of said first receptacle, and for rearward discharging engagement being achieved by said upper free end thereof being seated in the downwardly opened recess in the rearward inside surface portion of said upper strip member.

10. A finger-toe nail clipper having shifting receptacle as defined in claim 1, wherein said receptacle is slidably received between said strip members for longitudinal shifting relative thereto between forward and rearward active and inactive positions, respectively, and with keeping said receptacle in rearward position, one could enjoy the conventional cutting manner of currently available merchandise as in times desired.

* * * * *